US011694654B1

(12) United States Patent
Wang et al.

(10) Patent No.: US 11,694,654 B1
(45) Date of Patent: Jul. 4, 2023

(54) DISPLAY BRIGHTNESS ADJUSTMENT SYSTEM

(71) Applicant: Toshiba Global Commerce Solutions Holdings Corporation, Tokyo (JP)

(72) Inventors: Chih-Huang Wang, Taipei (TW); Wei-Yi Hsuan, Taipei (TW); Te-Chia Tsai, Taipei (TW); Yi-Sheng Lee, Taipei (TW)

(73) Assignee: Toshiba Global Commerce Solutions Holdings Corporation, Tokyo (JP)

( * ) Notice: Subject to any disclaimer, the term of this patent is extended or adjusted under 35 U.S.C. 154(b) by 0 days.

(21) Appl. No.: 17/708,884

(22) Filed: Mar. 30, 2022

(51) Int. Cl.
*G09G 5/10* (2006.01)

(52) U.S. Cl.
CPC ..... *G09G 5/10* (2013.01); *G09G 2320/0626* (2013.01); *G09G 2360/144* (2013.01)

(58) Field of Classification Search
CPC ..... G09G 5/10; G09G 2320/0626; G09G 2360/144
See application file for complete search history.

(56) References Cited

U.S. PATENT DOCUMENTS 8,068,178 B2 * 11/2011 Hardacker ..... H04N 21/42202 348/553
8,456,104 B2 * 6/2013 Allard ..... G09G 3/3413 345/204
2010/0052548 A1 * 3/2010 Allard ..... G09G 3/3413 315/291
2010/0289666 A1 * 11/2010 Hardacker ..... H04N 21/4318 340/815.45
2015/0002411 A1 * 1/2015 Hwang ..... G06F 3/041 345/173
2015/0022424 A1 * 1/2015 Jepsen ..... G09F 9/3026 345/1.3
2018/0157217 A1 * 6/2018 Song ..... G04B 19/223
2019/0244395 A1 * 8/2019 Hyun ..... G09G 5/02
2021/0193973 A1 * 6/2021 Ham ..... G02F 1/133512

* cited by examiner

*Primary Examiner* — Rodney Amadiz
(74) *Attorney, Agent, or Firm* — Patterson + Sheridan, LLP

(57) ABSTRACT

The present disclosure provides a system and method for adjusting display brightness. The method includes determining a color of a bezel surrounding a display and automatically adjusting a brightness of the display based on the color of the bezel.

20 Claims, 7 Drawing Sheets

DISPLAY BRIGHTNESS ADJUSTMENT SYSTEM

BACKGROUND

The present disclosure relates to displays, and more specifically, to brightness adjustment in the displays. Displays (e.g., displays at store self-checkout stations or computer displays) may be framed or surrounded by a bezel (e.g., a plastic bezel) that protects the display and the inner components of the display. The bezels may be any color, but the shade of the color of the bezel may create an optical illusion for a person viewing the display. For example, if there are two displays showing the same content and at the same brightness but one display has a bezel that is darker than the bezel of the other display, then the content in the display with the darker bezel will appear darker than the content in the display with the lighter bezel. In some instances, the content in the display with the lighter bezel may appear so bright that it causes discomfort to the person viewing the display, even though the brightness of both displays is identical.

DETAILED DESCRIPTION

The present disclosure describes a computer system that automatically adjusts the brightness level of a display to accommodate for the color of the bezel framing or surrounding the display. This technique may be performed for any suitable electronic display (e.g., a display at a self-checkout station in a store or a computer display). First, the computer system may determine the color of the bezel using any suitable technique. For example, the bezel color may be hardcoded. As another example, a sensor (e.g., a color sensor or luminosity sensor) may detect the color of the bezel. Second, the brightness level of the display is automatically and inversely adjusted relative to the brightness of the color of the bezel. For example, if the bezel is dark, then the brightness level of the display may be increased. If the bezel is white, then the brightness level of the display may be decreased. In this manner, the brightness level of the display is automatically adjusted to compensate for the optical illusion created by the bezel color, which reduces the discomfort of a person viewing the display, in certain embodiments.

Advantages of the Computer System

The computer system improves the comfort of a person viewing the display, in certain embodiments. Specifically, the computer system automatically adjusts the brightness level of a display to counteract the optical illusion created by the color of the bezel framing or surrounding the display. In this manner, the computer system sets the brightness level of the display so that the content displayed by the display does not appear too dark or too bright to the person viewing the display, which improves that person's comfort.

Figure 1:
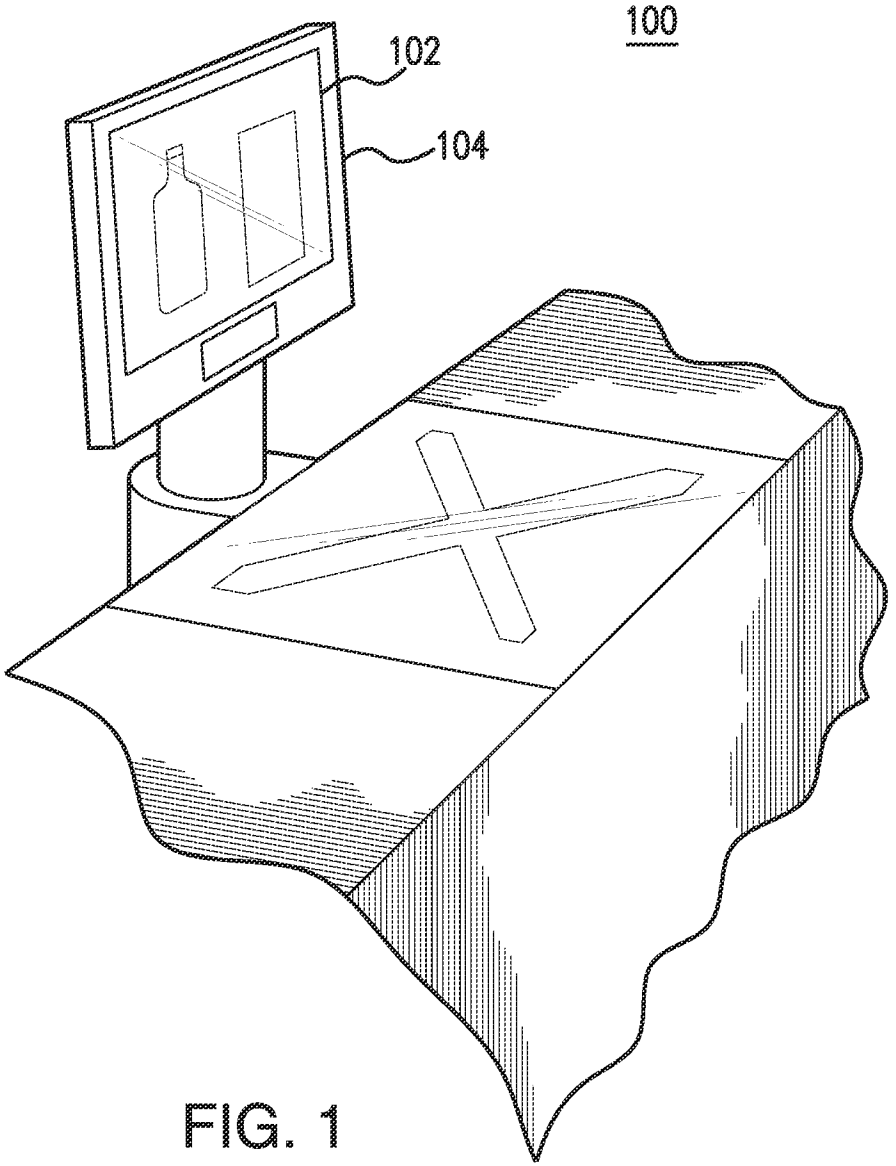
FIG. 1 illustrates an example system.

FIG. 1 illustrates an example system 100. The system 100 may be a checkout station (e.g., a self-checkout station in a grocery store). As seen in FIG. 1, the system 100 includes a display 102 framed or surrounded by a bezel 104. In certain embodiments, the system 100 automatically adjusts the brightness of the display 102 based upon a color of the bezel 104. As a result, the system 100 improves the comfort of a user viewing the display 102 by compensating for the effects of an optical illusion caused by the color of the bezel 104.

The display 102 may present images to a user viewing the display 102. For example, the display 102 may include an array of pixels that change colors to form an image for the user to view. When the display 102 is part of a checkout station at a store, the display 102 may present images of items sold in the store and information about pricing and charges for the user. A number of settings for the display 102 may be adjusted to improve the comfort of the user viewing the display 102. For example, a brightness level, contrast level. and color of the display 102 may be adjusted so that the display 102 does not discomfort the user's eyes when the user is viewing the display 102. The display 102 may be used in any suitable device, such as a computer monitor or television screen.

The bezel 104 may be any suitable material that frames or surrounds the display 102. For example, the bezel 104 may be a plastic border that frames or surrounds the display 102. The bezel 104 may be a color that contrasts with the surrounding environment so that the bezel 104 creates a visual frame for the display 102. As a result, the bezel 104 may establish a visual boundary for the display 102 so that the user may easily discern the contents and boundaries of the display 102 from the surrounding environment.

In some instances, the color of the bezel 104 may cause an optical illusion that makes the content in the display 102 appear brighter or darker than the content actually is. For example, when the bezel 104 is a bright color, such as white, the bezel 104 causes the content in the display 102 to appear brighter than the content actually is. When a user views the display 102, the user may experience discomfort, because the user may perceive the content in the display 102 as brighter than the content actually is. As another example, when the bezel 104 is a dark color, such as black, the bezel 104 may cause the content in the display 102 to appear darker than the content actually is. When a user views the display 102, the user may experience discomfort attempting to focus on the content in the display 102, because the content appears darker than the content actually is.

The system 100 compensates for the effects of this optical illusion by detecting the color of the bezel 104 and automatically adjusting the brightness level of the display 102. For example, if the system 100 determines that the bezel 104 is a bright color, then the system 100 may reduce the brightness level of the display 102. As another example, if the system 100 determines that the bezel 104 is a dark color, then the system 100 may increase the brightness level of the display 102. As a result, the system 100 adjusts the brightness level of the display 102 so that the perceived brightness level of the content in the display 102 does not cause discomfort for a user, in certain embodiments.

Figure 2:
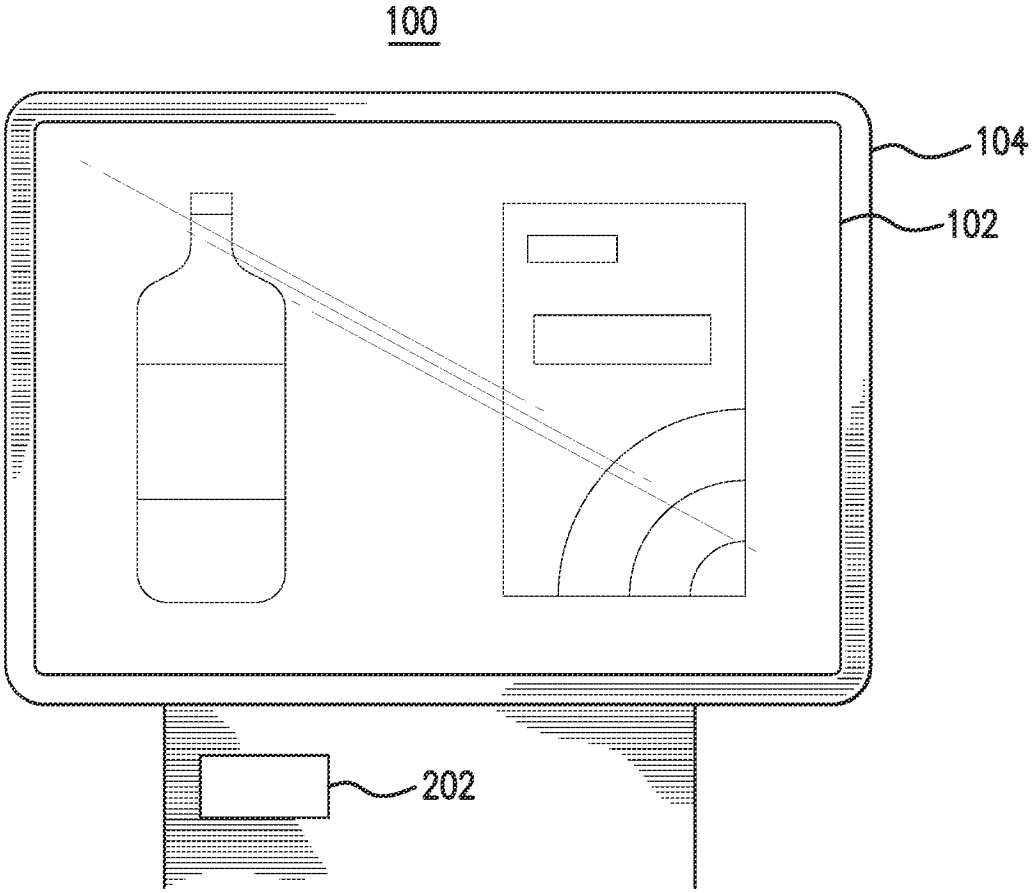
FIG. 2 illustrates an example portion of the system of FIG. 1.

FIG. 2 illustrates an example portion of the system 100 of FIG. 1. As seen in FIG. 2, the system 100 includes a sensor 202 positioned outside the bezel 104. For example, the sensor 202 may be a color sensor directed at the bezel 104. The color sensor 202 detects the color of the bezel 104 and outputs a signal indicating the detected color. In some embodiments, the system 100 adjusts the brightness of the display 102 based on the color detected by the sensor 202. For example, if the sensor 202 detects that the bezel 104 is a bright color, such as white, the system 100 reduces the brightness level of the display 102. As another example, if the sensor 202 detects that the bezel 104 is a dark color, such as black, the system 100 increases the brightness level of the display 102. In this manner, the sensor 202 determines the color of the bezel 104, and the system 100 adjusts the brightness level of the display 102 based on that detected color to reduce discomfort caused by the perceived brightness of the content in the display 102.

Figure 3:
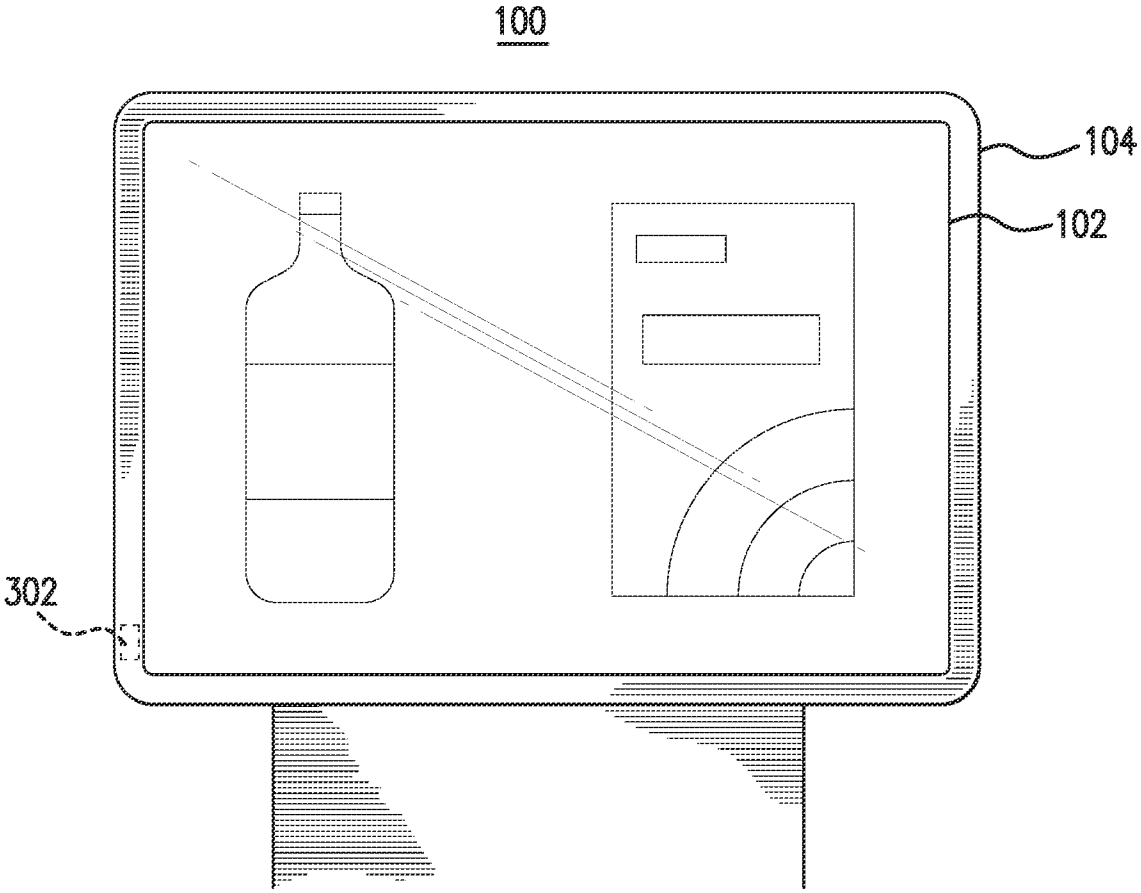
FIG. 3 illustrates an example portion of the system of FIG. 1.

FIG. 3 illustrates an example portion of the system 100 of FIG. 1. In the example of FIG. 3, the system 100 includes a sensor 302 positioned within the bezel 104. For example, the sensor 302 may be an intensity or luminosity sensor that detects an intensity or luminosity of ambient light that penetrates the bezel 104. The sensor 302 then outputs a signal that indicates the detected intensity or luminosity. The system 100 may determine a color or shade of the bezel 104 based on the detected intensity or luminosity. For example, a higher detected intensity or luminosity may indicate that the bezel 104 has a brighter color or shade. The system 100 then automatically adjusts the brightness level of the display 102 based on the color or shade of the bezel 104. For example, if the system 100 determines that the bezel 104 is a bright color or shade, the system 100 reduces the brightness level of the display 102. As another example, if the system 100 determines that the bezel 104 is a dark color or shade, the system 100 increases the brightness level of the display 102. In this manner, the system 100 automatically adjusts the brightness level of the display 102, which reduces discomfort caused by the apparent brightness of the content in the display 102.

Figure 4:
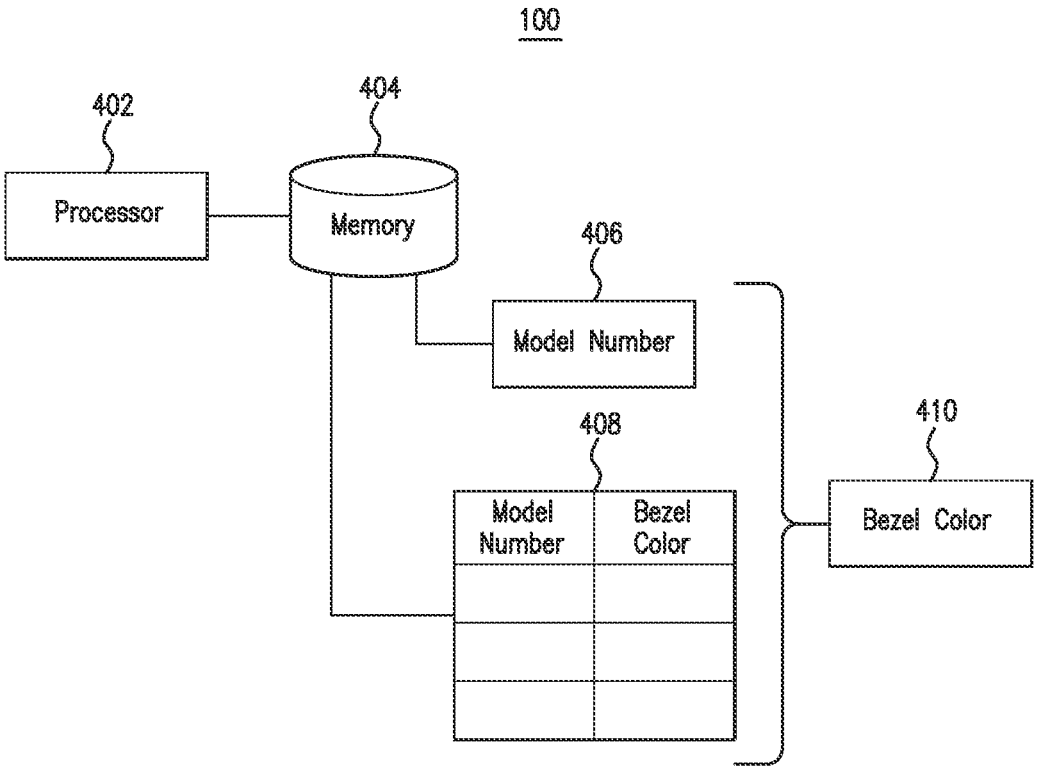
FIG. 4 illustrates an example bezel color identification in the system of FIG. 1.

FIG. 4 illustrates an example bezel color identification in the system 100 of FIG. 1. As seen in FIG. 4, the system 100 includes a processor 402 and a memory 404 that perform the functions or actions of the system 100 described herein.

The processor 402 is any electronic circuitry, including, but not limited to one or a combination of microprocessors, microcontrollers, application specific integrated circuits (ASIC), application specific instruction set processor (ASIP), and/or state machines, that communicatively couples to memory 404 and controls the operation of the system 100. The processor 402 may be 8-bit, 16-bit, 32-bit, 64-bit or of any other suitable architecture. The processor 402 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. The processor 402 may include other hardware that operates software to control and process information. The processor 402 executes software stored on the memory 404 to perform any of the functions described herein. The processor 402 controls the operation and administration of the system 100 by processing information (e.g., information received from the sensor 202, sensor 302, and memory 404). The processor 402 is not limited to a single processing device and may encompass multiple processing devices.

The memory 404 may store, either permanently or temporarily, data, operational software, or other information for the processor 402. The memory 404 may include any one or a combination of volatile or non-volatile local or remote devices suitable for storing information. For example, the memory 404 may include random access memory (RAM), read only memory (ROM), magnetic storage devices, optical storage devices, or any other suitable information storage device or a combination of these devices. The software represents any suitable set of instructions, logic, or code embodied in a computer-readable storage medium. For example, the software may be embodied in the memory 404, a disk, a CD, or a flash drive. In particular embodiments, the software may include an application executable by the processor 402 to perform one or more of the functions described herein.

As seen in FIG. 4, the memory 404 stores a model number 406. The model number 406 may identify one or more components in the system 100. For example, the model number 406 may identify a checkout station, the display 102, or the bezel 104. Additionally, the memory 404 stores a table 408 that maps various model numbers to certain bezel colors. The processor 402 may use the model number 406 and the table 408 to determine a bezel color 410 of the bezel 104 in the system 100. For example, the processor 402 may search the table 408 for a model number that matches the model number 406. When the processor 402 locates the model number in the table 408, the processor 402 determines the bezel color that is mapped to that model number in the table 408. The processor 402 then determines that the mapped bezel color is the bezel color 401 for the bezel 104.

In some embodiments, rather than using a model number 406 and table 408, the bezel color 410 may be hardcoded into software stored by the memory 404. The processor 402 may determine the bezel color 410 by directly retrieving the bezel color 410 from the memory 404.

Figure 5:
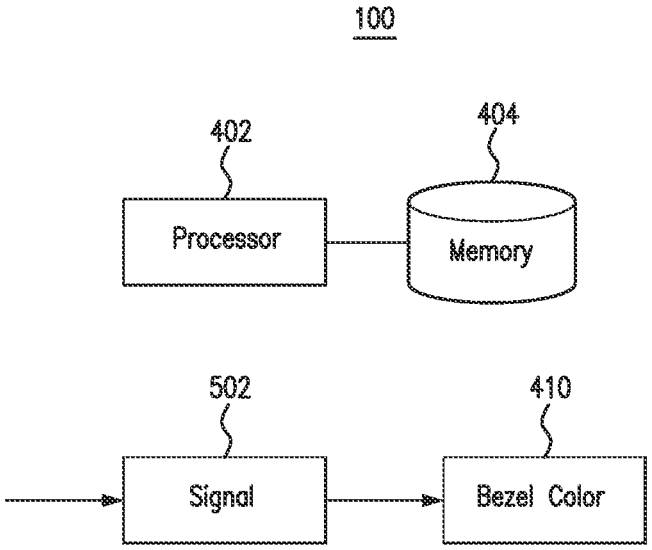
FIG. 5 illustrates an example bezel color identification in the system of FIG. 1.

FIG. 5 illustrates an example bezel color identification in the system 100 of FIG. 1. As seen in FIG. 5, the processor 402 receives a signal 502. The signal 502 may have been communicated by a sensor (e.g., the sensor 202 or the sensor 302). The signal 502 may indicate a detected color, intensity, or luminosity. The processor 402 analyzes the signal 502 to determine the bezel color 410 of the bezel 104. For example, if the signal 502 was outputted by a color sensor, the signal 502 may indicate a detected color. The processor 402 may use this detected color as the color for the bezel 104. As another example, if the signal 502 were output by an intensity or luminosity sensor, the signal 502 may indicate an intensity or luminosity of detected light that penetrated the bezel 104. The processor 402 may determine the bezel color 410 based on this detected intensity or luminosity. In certain embodiments, the processor 402 may not determine an exact color of the bezel 104. It is sufficient for the processor 402 to approximate the color of the bezel 104 and adjust the brightness of the display 102 accordingly. For example, it may be sufficient for the processor 402 to identify the color of the bezel 104 as a color having a similar brightness or darkness as the actual color of the bezel 104.

In certain embodiments, the processor 402 may detect a new color for the bezel 104 when the bezel 104 has been repainted or replaced by another bezel (e.g., during maintenance). When the color of the bezel 104 changes, the signal 502 received by the processor 402 also changes. For example, the color sensor, intensity sensor, or luminosity sensor communicates a different signal 502 indicating a change in the color of the bezel 104. When the processor 402 determines that the color of the bezel 104 has changed, the processor 402 determines the new bezel color 410 using the information in the signal 502. The processor 402 then adjusts the brightness of the display 102 based on the new color. For example, if the new color of the bezel 104 is brighter than the previous color, the processor 402 may reduce the brightness of the display 102. If the new color of the bezel 104 is darker than the previous color, the processor 402 may increase the brightness of the display 102. In this manner, the processor 402 automatically adjusts the brightness of the display 102 even when the bezel 104 changes, which reduces visual discomfort caused by the optical illusion created by the bezel color 104, in certain embodiments.

Figure 6:
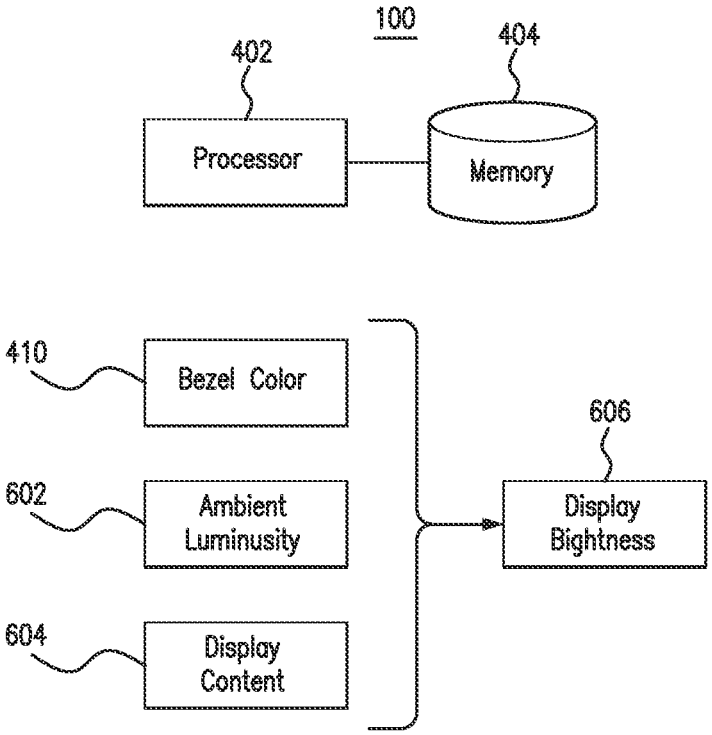
FIG. 6 illustrates an example display brightness adjustment in the system of FIG. 1.

FIG. 6 illustrates an example of display brightness adjustment in the system 100 of FIG. 1. As seen in FIG. 6, the processor 402 has determined the bezel color 410. The processor 402 then determines a display brightness 606 based on the bezel color 410. For example, if the processor 402 determines that the bezel color 410 is a bright color, such as white, the processor 402 may determine a display brightness 606 that represents a reduced brightness level. As another example, if the processor 402 determines that the bezel color 410 is a dark color, such as black, the processor 402 may determine a display brightness 606 that represents an increased brightness level. The processor 402 then sets the brightness level of the display 102 using the determined display brightness 606. In this manner, the processor 402 automatically adjusts the brightness level of the display 102 to compensate for an optical illusion created by the bezel color 410.

In certain embodiments, the processor 402 determines the display brightness 606 using additional factors. For example, the processor 402 may receive an ambient luminosity 602. The ambient luminosity 602 may be provided by a luminosity sensor positioned in the system 100 (e.g., on the bezel 104). The luminosity sensor may detect a level of ambient light in the system 100. Based on the detected level of ambient light, the processor 402 may determine the display brightness 606 while accounting for the ambient luminosity 602. If the ambient luminosity 602 is high, indicating that there is a large amount of ambient light, the processor 402 may determine the display brightness 606 to be brighter. As another example, if the ambient luminosity 602 is low, indicating that there is not a large amount of ambient light, the processor 402 may determine the display brightness 606 to be darker. In this manner, the processor 402 determines the display brightness 606 to make the display 102 easier to see in the detected ambient lighting.

In an example, the system 100 may be a checkout station in a grocery store. The checkout station may be positioned by a window. During the day, sunlight may come through the window and increase the amount of detected ambient light. In response, the processor 402 increases the brightness of the display 102 so that a shopper can more easily see the content in the display 102. During the evening, there may be less detected ambient light. In response, the processor 402 decreases the brightness of the display 102 so that the brightness of the display does not cause discomfort for the shopper.

The processors 402 may also consider the display content 604 of the display 102 when determining the display brightness 606. The display content 604 may indicate the brightness of the colors of the objects or other content being displayed by the display 102. If the processor 402 determines that the display content 604 includes bright colors, then the processor 402 may determine the display brightness 606 to be darker. As another example, if the processor 402 determines that the display content 604 includes dark colors, the processor 402 may determine the display brightness 606 to be brighter. In this manner, the processor 402 determines the display brightness 606 to reduce discomfort caused by bright content being displayed by the display 102.

Figure 7:
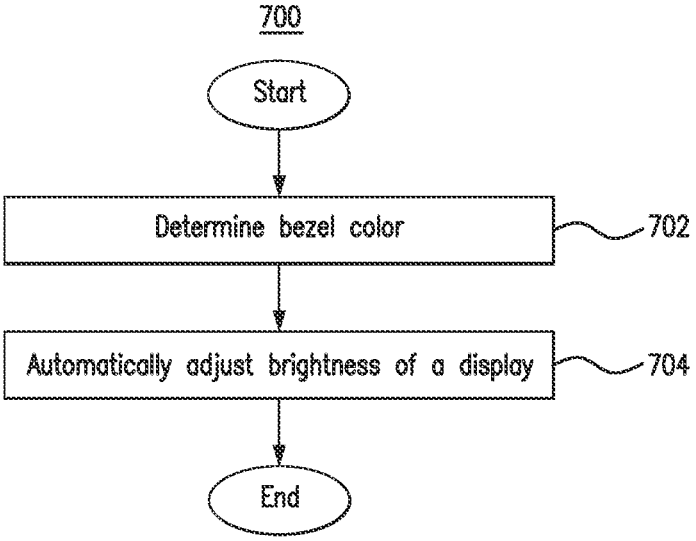
FIG. 7 is a flowchart of an example method performed in the system of FIG. 1.

FIG. 7 is a flowchart of an example method 700 performed in the system 100 of FIG. 1. In particular embodiments, the processor 402 performs the method 700. By performing the method 700, the processor 402 automatically adjusts a brightness level of a display 102 based on a color of a bezel 104 framing or surrounding the display of 102. As a result, the processor 402 reduces discomfort caused by an optical illusion created by the color of the bezel 104.

In block 702, the processor 402 determines the bezel color 410. In certain embodiments, the processor 402 determines the bezel color 410 based on signals 502 communicated by one or more sensors. For example, the signals 502 may be communicated by a color sensor directed at the bezel 104. The color sensor detects the color of the bezel 104 and communicates the signal 502 indicating the detected color. The processor 402 analyzes the signal 502 to determine the bezel color 410. As another example, the signal 502 may indicate an intensity or luminosity detected by an intensity or luminosity sensor positioned within the bezel 104. The intensity or luminosity sensor may detect the intensity or luminosity of light that penetrates the bezel 104. The processor 402 analyzes the signal 502 to determine the bezel color 410 based on the detected intensity or luminosity.

In block 704, the processor 402 automatically adjusts the brightness of the display 102 based on the bezel color 410. For example, if the processor 402 determines that the bezel color 410 is a bright color, such as white, the processor 402 reduces the brightness level of the display 102. As another example, if the processor 402 determines that the bezel color 410 is a dark color, such as black, the processor 402 increases the brightness level of the display 102. In this manner, the processor 402 compensates for the optical illusion caused by the bright or dark bezel color, which improves the comfort of a user viewing the display 102. The magnitude of the brightness adjustment may depend on how bright or how dark the bezel 104 is. For example, the brightness of the display 102 may be increased more when the bezel 104 is black than when the bezel 104 is a dark shade of gray. As another example, the brightness of the display 102 may be decreased more when the bezel is white than when the bezel 104 is yellow.

In some embodiments, the processor 402 considers other factors when adjusting the brightness level of the display 102. For example, the processor 402 may consider an ambient luminosity 602 detected by a luminosity sensor attached to the display 102 or the bezel 104. The luminosity sensor may detect a level of ambient light in the system 100. The processor 402 adjusts the brightness of the display 102 based on the detected ambient lighting. For example, if there is a large amount of ambient lighting in the system 100, the processor 402 may increase the brightness of the display 102. As another example, if there is not much ambient lighting, then the processor 402 reduces the brightness level of the display 102. In this manner, the processor 402 makes it easier for the user to see the content displayed by the display 102 in the ambient lighting.

As another example, the processor 402 may consider the content displayed by the display 102 in adjusting the brightness level of the display 102. For example, if the display 102 is displaying bright colors, then the processor 402 may reduce the brightness level of the display 102. As another example, if the display 102 is displaying darker colors, then the processor 402 may increase the brightness level of the display 102. In this manner, the processor 402 reduces discomfort caused by viewing bright or dark colors on the display 102.

In summary, a computer system 100 automatically adjusts the brightness level of a display 102 to accommodate for the color of the bezel 104 framing or surrounding the display 102. This technique may be performed for any suitable electronic display (e.g., a display at a self-checkout station in a store or a computer display). First, the computer system 100 may determine the color of the bezel 104 using any suitable technique. For example, the bezel color 410 may be hardcoded. As another example, a sensor (e.g., a color sensor or luminosity sensor) may detect the color of the bezel 104. Second, the brightness level of the display 102 is automatically and inversely adjusted relative to the brightness of the color of the bezel 104. For example, if the bezel 104 is dark, then the brightness level of the display 102 may be increased. If the bezel 104 is white, then the brightness level of the display 102 may be decreased. In this manner, the brightness level of the display 102 is automatically adjusted to compensate for the optical illusion created by the bezel color 410, which reduces the discomfort of a person viewing the display 102, in certain embodiments.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

In the following, reference is made to embodiments presented in this disclosure. However, the scope of the present disclosure is not limited to specific described embodiments. Instead, any combination of the following features and elements, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the following aspects, features, embodiments and advantages are merely illustrative and are not considered elements or limitations of the appended claims except where explicitly recited in a claim(s).

Aspects of the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system."

Embodiments of the present disclosure may include a system, a method, and/or a computer program product. The computer program product may include a computer readable storage medium (or media) having computer readable program instructions thereon for causing a processor to carry out aspects of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a computer or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the foregoing is directed to embodiments of the present disclosure, other and further embodiments of the disclosure may be devised without departing from the basic scope thereof, and the scope thereof is determined by the claims that follow.

What is claimed is:

1. A method comprising:

determining a first color of a first bezel surrounding a display; and automatically adjusting a brightness of the display based on the first color of the first bezel such that the adjustment of the brightness is inversely related with a brightness of the first color of the first bezel.

2. The method of claim 1, wherein determining the first color of the first bezel comprises:

retrieving a model number of the display stored in a memory; and querying a table of bezel colors using the model number.

3. The method of claim 1, wherein determining the first color of the first bezel is performed using a color sensor directed at the first bezel.

4. The method of claim 1, wherein determining the first color of the first bezel is performed using a luminosity sensor within the first bezel, wherein the luminosity sensor is arranged to detect an amount of ambient light that penetrates the first bezel.

5. The method of claim 1, wherein automatically adjusting the brightness of the display is further based on a color of content displayed by the display.

6. The method of claim 1, wherein automatically adjusting the brightness of the display is further based on at least an ambient luminosity.

7. The method of claim 1, further comprising automatically decreasing the brightness of the display in response to a sensor detecting a second color of a second bezel brighter than the first color of the first bezel after the first bezel has been replaced with the second bezel.

8. A system comprising:

a display;

a first bezel surrounding the display;

a memory; and a hardware processor communicatively coupled to the memory, the hardware processor configured to:

determine a first color of the first bezel; and automatically adjust a brightness of the display based on the first color of the first bezel such that the adjustment of the brightness is inversely related with a brightness of the first color of the first bezel.

9. The system of claim 8, wherein determining the first color of the first bezel comprises:

retrieving a model number of the display stored in a memory; and querying a table of bezel colors using the model number.

10. The system of claim 8, further comprising a color sensor directed at the first bezel, wherein determining the first color of the first bezel is based on signals from the color sensor.

11. The system of claim 8, further comprising a luminosity sensor within the first bezel and arranged to detect an amount of ambient light that penetrates the first bezel, wherein determining the first color of the first bezel is performed using signals from the luminosity sensor.

12. The system of claim 8, wherein automatically adjusting the brightness of the display is further based on a color of content displayed by the display.

13. The system of claim 8, wherein automatically adjusting the brightness of the display is further based on at least an ambient luminosity.

14. The system of claim 8, wherein the hardware processor is further configured to automatically decrease the brightness of the display in response to a sensor detecting a second color of a second bezel brighter than the first color of the first bezel after the first bezel has been replaced with the second bezel.

15. A non-transitory computer readable medium storing instructions that, when executed by a hardware processor, cause the hardware processor to:

determine a first color of a first bezel surrounding a display; and automatically adjust a brightness of the display such that the adjustment of the brightness is inversely related with a brightness of the color of the bezel.

16. The medium of claim 15, wherein determining the color of the bezel comprises:

retrieving a model number of the display stored in a memory; and querying a table of bezel colors using the model number.

17. The medium of claim 15, wherein determining the color of the bezel is performed using a color sensor directed at the bezel.

18. The medium of claim 15, wherein determining the color of the bezel is performed using a luminosity sensor within the bezel, wherein the luminosity sensor is arranged to detect an amount of ambient light that penetrates the bezel.

19. The medium of claim 15, wherein automatically adjusting the brightness of the display is further based on a color of content displayed by the display.

20. The medium of claim 15, wherein automatically adjusting the brightness of the display is further based on at least an ambient luminosity.

* * * * *